United States Patent [19]

Yanagioka

[11] 4,113,248

[45] Sep. 12, 1978

[54] BASEBALL BAT MADE OF LIGHT ALLOY

[75] Inventor: Seiichi Yanagioka, Hiratsuka, Japan

[73] Assignee: Aikoh Co., Ltd., Tokyo, Japan

[21] Appl. No.: 684,351

[22] Filed: May 7, 1976

[51] Int. Cl.[2] ..... A63B 59/06

[52] U.S. Cl. ..... 273/72 A; 148/31.5; 204/49; 428/652

[58] Field of Search ..... 273/67 DC, 72 R, 72 A, 273/73 R, 73 C, 73 K, 80 R, 82 R, 82 A; 29/191, 197; 204/37, 49; 427/438

[56] References Cited

U.S. PATENT DOCUMENTS

| | | | |
|---|---|---|---|
| 3,083,968 | 4/1963 | Takahashi | 273/73 R |
| 3,165,823 | 1/1965 | Rowady | 29/197 |
| 3,782,978 | 1/1974 | Souza | 29/197 |

OTHER PUBLICATIONS

"Symposium on Electroless Nickel Plating", published by Amer. Soc. for Testing Mat'ls; 1959; pp. 37 and 64.

"The Sporting Goods Dealer"; Dec. 1969, p. 13.

*Primary Examiner*—Richard J. Apley

*Attorney, Agent, or Firm*—Fay & Sharpe

[57] ABSTRACT

A baseball bat made of a light alloy having on its surface a plating of heat hardened nickel-phosphorus or nickel-boron alloy.

3 Claims, 1 Drawing Figure

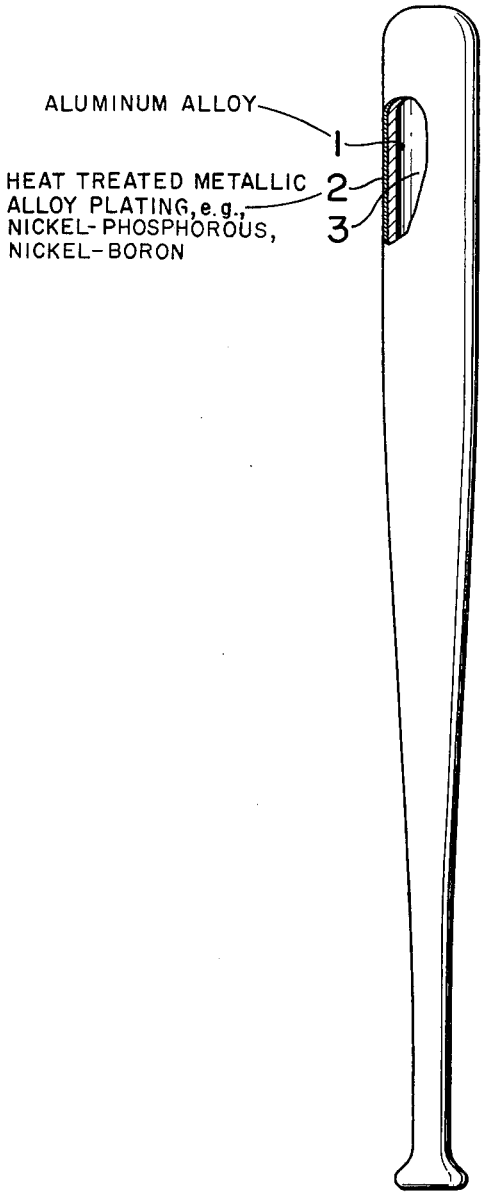
ALUMINUM ALLOY
1
HEAT TREATED METALLIC
ALLOY PLATING, e.g.,
NICKEL-PHOSPHOROUS,
NICKEL-BORON
2
3

BASEBALL BAT MADE OF LIGHT ALLOY

This invention relates to an improvement of a baseball bat made of a light alloy.

It is known that a bat made of a light alloy can, as a substitute for a wooden bat, increase impulsion and lengthen the flying distance of a batted ball thanks to its excellent durability and hardness. Most of the light alloy materials suitable for such use are those which are endowed with the maximum strength among light alloys, in which aluminium alloy, and more in particular duralumin type alloy is applied with a forging and a thermal treatment so that Vickers hardness may be about 110 - 130, the tensile strength may be greater than 30 kg/mm$^2$ and the elongation may be greater than 14%, in consideration of strength and economy. Conventionally the light alloy materials for such use are plated on their surfaces with alumite for corrosion resistancy.

The bat of the present invention more increases the repulsion and decreases the wear which may be caused by batting, in comparison with conventional light alloy bats, and the surface of the bat of the invention is applied with a heat-treated nickel-phosphorus or nickel-boron alloy coating having a high hardness.

Nickel-phosphorus or nickel-boron alloy has Vickers hardness of more than 450 as it is and of more than 940 according to the conditions of heat-treatment so as to come under the hardest materials among alloys, so that with the existence of the coating there is produced a hardened layer on the surface and it is capable of increasing the instantaneous repulsion for the batted ball.

Vickers hardness becomes 500 or so even with said alumite plating for the only purpose of increasing the surface hardness. However, alumite is lacking in ductility and the adhesiveness (force of adhesion to substrate) is less than 1 kg/mm$^2$, while in the case of alloy plating layer of the invention the adhesiveness will be 5 - 30 kg/mm$^2$ which is exceptionally high as compared with that of alumite. In other words, when the bat is contacted by the ball the alumite coating has a tendency to peal off due to its low adhesive strength leaving the base alloy of the bat subject to attack. The nickel-phosphorus or nickel-boron alloys do not lose their metallic properties and have a high hardness and an excellent adhesiveness so that they are ideal as coating materials for an alloy bat.

Both electroless plating and conventional electroplating techniques may be used to produce the bat of the invention. A heat treatment is applied at a temperature up to maximum 450° C after plating, however, if greater hardness is desired, the heat treating temperature is increased because hardness increases as the temperature is raised.

The accompanying drawing is a portional cross sectional and broken view of a baseball bat according to the invention, in which A designates the bat of the invention and reference numeral 1 shows light alloy material of the bat, reference 2 a nickel-phosphorus or nickel-boron alloy coating of surface plating, and numeral 3 a hollow portion respectively.

In order that the invention may be more clearly understood there will be described below an example in which the article of the present invention was manufactured according to the electroless plating method.

EXAMPLE

A duralumin type alloy material which was previously processed for bat material was pre-treated with trichorethylene degreasing, nitric acid washing, aluminium substitution, water washing, to carry out an electroless plating by immersing the alloy material in the following electroless plating bath:

| | | |
|---|---|---|
| (1) | Nickel-phosphorus alloy plating bath | |
| | Nickel sulphate | 30 g/l. |
| | Ammonium sulphate | 60 g/l. |
| | Sodium hypophosphite | 10 g/l. |
| | pH | 10 |
| (2) | Nickel-boron alloy plating bath | |
| | Nickel acetate | 60 g/l. |
| | Glycollic acid | 60 g/l. |
| | EDTA - 2 Na | 25 g/l. |
| | Hydrazine | 100 ml/l. |
| | pH | 11 |

In each of the above plating bath there was immersed a bat material (heat-treated duralumin whose hardness is 120 Hv, tensile strength 40 kg/mm$^2$ and elongation 15%) to effect a plating treatment under the following various conditions:

| Plating bath | (1) | (2) |
|---|---|---|
| Treatment temperature | 85° C | 90° C |
| Treatment time (Hrs) | 2 | 2 |
| Plating layer thickness (μ) | 30 | 25 |
| Plating layer components | 6% P-Ni | 7% B-Ni |

The alloy materials thus plated were washed by water, dried at 120° C, heated for one hour at 200° C and 400° C respectively and then slowly cooled for ten hours. The following table shows and compares the listed physical properties of plating layers produced by techniques (1) and (2), as described hereinbefore, which have not been heat treated, have been heat treated at 200° C, and have been heat treated at 400° C.

| | Thermal treatment at 200° C | | | Thermal treatment at 400° C | | | No thermal treatment | | |
|---|---|---|---|---|---|---|---|---|---|
| | Plating layer by (1) | Plating layer by (2) | Duralu min | Plating layer by (1) | Plating layer by (2) | Duralu min | Plating layer by (1) | Plating layer by (2) | Duralu min |
| Hardness (Hv) | 700 | 750 | 110 | 1000 | 1200 | 100 | 500 | 550 | 110 |
| Adhesiveness (kg/mm$^2$) | 15 | 12 | — | 10 | 8 | — | 5 | 5 | — |

What I claim is:

1. A baseball bat having a barrel portion and a handle portion comprised of an aluminum alloy having on its surface a heat treated metallic alloy plating selected from the group consisting of nickel-phosphorus and nickel-boron, said metallic plating having been heat treated at a temperature sufficient to cause said plating to have a Vickers hardness in excess of about 550.

2. The baseball bat of claim 1 wherein said Vickers hardness ranges from about 700 to 1200.

3. The baseball bat of claim 1 wherein said bat has been heat treated at a temperature ranging from about 220° to about 400° C.

* * * * *